US006634143B1

(12) United States Patent
Yoo

(10) Patent No.: US 6,634,143 B1
(45) Date of Patent: Oct. 21, 2003

(54) CHARNEL SYSTEM HAVING INDEPENDENTLY DIVIDED CELLS

(76) Inventor: Gwang-Jln Yoo, 107-2101 Saetbycol-Macul, 34 Bundang-gu, Seongham, Gyconggi-do, 463-030 (KR)

( * ) Notice: Subject to any disclaimer, the term of this patent is extended or adjusted under 35 U.S.C. 154(b) by 0 days.

(21) Appl. No.: 10/129,742

(22) PCT Filed: Oct. 9, 2000

(86) PCT No.: PCT/KR00/01124

§ 371 (c)(1),
(2), (4) Date: May 10, 2002

(87) PCT Pub. No.: WO01/36767

PCT Pub. Date: May 25, 2001

(30) Foreign Application Priority Data

Nov. 15, 1999 (KR) ..... 99-0050654
Nov. 15, 1999 (KR) ..... 99-0050656

(51) Int. Cl.[7] ..... E04H 13/00

(52) U.S. Cl. ..... 52/136; 52/106; 211/85.27; 348/14.08

(58) Field of Search ..... 52/136, 106; 27/27, 27/35; 211/85.16, 85.27; 348/14.08

(56) References Cited

U.S. PATENT DOCUMENTS 5,261,197 A * 11/1993 Pickle, Sr.

FOREIGN PATENT DOCUMENTS

| | | |
|---|---|---|
| JP | 2-45247 | 3/1990 |
| JP | 6-146663 | 5/1994 |
| JP | 8-158701 | 6/1996 |
| JP | 8-305764 | 11/1996 |

OTHER PUBLICATIONS

Publication No.: US 2002/0024590 A1 Feb. 2002 Pena.*

* cited by examiner

*Primary Examiner*—Carl D. Friedman
*Assistant Examiner*—Nahid Amiri
(74) *Attorney, Agent, or Firm*—Dann, Dorfman, Herrell and Skillman; Henry H. Skillman

(57) ABSTRACT

Disclosed is an independently compartmental ash laying structure, comprising a plurality of ash laying rooms therewithin, which are individually divided and arranged in the form of cells to be collectively controlled, wherein each ash laying room has a door for controlling entrance and exit and a space for performing a ceremony in relation to a memorial service as well as storing ashes or articles left by the dead according to individuals, families, or specific groups.

3 Claims, 6 Drawing Sheets

CHARNEL SYSTEM HAVING INDEPENDENTLY DIVIDED CELLS

BACKGROUND OF THE INVENTION

1. Field of the Invention

The present invention generally relates to a charnel system having independently divided cells, and more particularly, to an independently compartmental ash laying structure provided with ash laying rooms, which can hold a memorial service within the rooms as well as storing ashes and articles left by the dead by allotting independent rooms in the form of cells according to individuals, families, or specific groups within the structure. The present invention further relates to ash laying rooms, which can share various information and relay a ceremony including a memorial service, etc., by establishing a network infrastructure interconnecting a plurality of ash laying rooms and connecting the ash laying rooms to the outside through an on-line system, i.e., Internet or the likes.

2. Description of the Related Art

Encroachment of national land due to an explosive increase of burial grounds in the limited land destroys the environment and increases the possibility of inducing a natural disaster as well as deteriorating efficiency in use of the land. In this circumstances, there has been requested to reconsider the existing burial system.

Recently, necessity of establishment of a new burial system has widely been recognized in order to protect and conserve national land and environments, especially in countries which follow a long-established tradition based on graves. Such a change in social understanding is earnestly seeking to establish a desirable burial system by efficiently utilizing the land and correcting wrong convention in the traditional burial system.

Under the circumstances that an ash laying structure is in a new understanding far and wide, breaking away from a biased view against cremation due to a wrong recognition about the conventional theory of geomancy and filial duty, a new conception about the ash laying structure in general is needed to meet the demands of reality. In particular, it is more desirable that the ash laying structure having been unwelcome by people is constructed in nature-friendly modern style to minimize dangerous effects on the environments.

However, the existing ash laying structures did no more than preserve ashes of the dead and thus have been unwelcome and unacceptable objects. In addition, since the existing ash laying structures fail to be in concert with extended ash preservation over a long period and to efficiently carry out post managements, they have a limit in getting along with the environments.

The existing ash laying structures, which did no more than provide the ash laying service, have further disadvantage that they can not meet various demands of families or acquaintances of the dead. Therefore, there has been sought to develop a system capable of ensuring a clear grasp of family histories in relation to acquaintance communities by systemically managing information and collecting dispersed materials and data concerning the dead. Moreover, people find a need that the materials and data can be read anytime and anywhere.

Additionally, the existing ash laying structures have still another problem that acquaintances living in the distance or in foreign countries can not participate in the memorial service, thereby increasing moral burdens on them.

The present invention is suggested to overcome the problem of excessive encroachment of the national land due to the existing burial system in conformity with the need of the times of improving the existing burial system.

SUMMARY OF THE INVENTION

It is, therefore, an object of the present invention to provide an independently compartmental ash laying structure, which can jointly utilize a place having the ash laying structure constructed therein as a resting or cultural place for the family of the dead and neighbors as well.

It is another object of the present invention to provide an independently compartmental ash laying structure, which can minimize harmful effects on the environments and promote efficiency in the structure management as well as maximizing practical use in lands by constructing the ash laying structure in modern style.

It is further object of the present invention to provide an independently compartmental ash laying structure, which can strengthen the ties and comfortably perform a memorial service within an isolated room by allotting and managing ash laying rooms, which are divided each in a cell form within the ash laying structure, according to families or specific groups.

It is still another object of the present invention to provide an independently compartmental ash laying structure, which can enable the family of the dead living in the distance or in foreign countries to indirectly participate in a memorial service almost in real time by transmitting a ceremony related to the memorial service performed in an ash laying room through on-line in real time.

It is yet another object of the present invention to provide an independently compartmental ash laying structure, which can promote interests in family history and strengthen the ties by systemically arranging and managing a variety of materials related to the dead in diverse manners and allowing the family or the acquaintances connected to the dead to read the materials at any time through on-line.

The ash laying structure according to the present invention is provided with a plurality of ash laying rooms within the independent ash laying structure, each of the ash laying rooms being arranged in an individually compartmental cell form to be collectively controlled. Each ash laying room has a door installed to control entrance and exit, and has a space for preserving ashes or articles of the dead and simultaneously performing a memorial service per individual, family or specific group.

It is desirable that the ash laying room has an ash box or an article box installed at a side wall facing the door for preserving the ashes or articles of the dead, a mortuary tablet and a portrait disposed on an upper side of the ash box or the article box, and the space reserved in front of the ash box or the article box for the memorial service or refreshment.

Further, with the respective ash laying rooms being interconnected with one another through a network, each ash laying room has a unmanned camera inside thereof for monitoring the space for memorial service or taking pictures of the memorial service, a computer for controlling the unmanned camera, receiving image data from the unmanned camera, storing and managing information in relation to the dead, and connecting to the network and transmitting the stored information to the outside through on-line, and a displayer connected to the computer for displaying the information processed in the computer.

Each computer installed at each ash laying room is connected to Internet through the network.

BRIEF DESCRIPTION OF THE DRAWINGS

The above and other objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
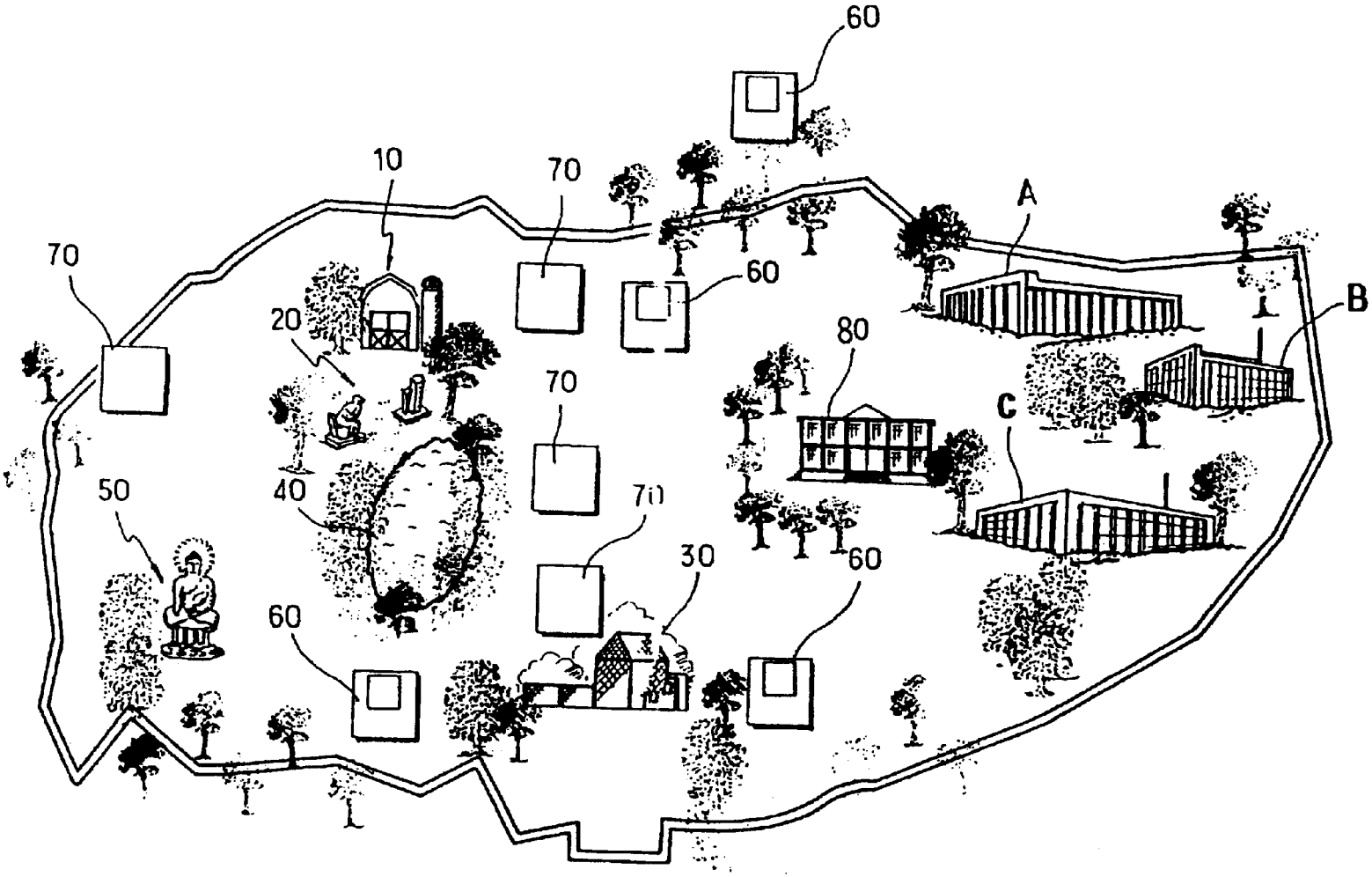
FIG. 1 is a view of a constitution of a park cemetery constructed to have an ash laying structure therein according to the present invention.

Referring to FIG. 1, an ash laying structure constructed in modern style at one side of a park cemetery may be divided into several buildings (A, B, C). A cultural center 10, a sculpture park 20, a botanical garden 30, a pond 40, etc. are constructed at other side of the park cemetery so as to be utilized as a resting place for the family of the dead or neighbors. In addition, a Buddhist temple 50, a church or a crematory is installable at the park cemetery as facilities for the burial. A variety of facilities including parking lots 60, rest areas 70, etc., are also installed between the basic equipments. The numeral 80, not described, is a park management building.

The ash laying structure 100 installed in the park cemetery according to the present invention has hundreds of ash laying rooms 110, 120, . . . 190 per story F1, F2, F3, and F4, which are independently comparted in the form of cells and constructed to be collectively controlled. Rest areas and facilities 210, 22, . . . 260 are also provided per story for serving convenience to the family of the dead or visitors of the ash laying rooms.

Figure 2:
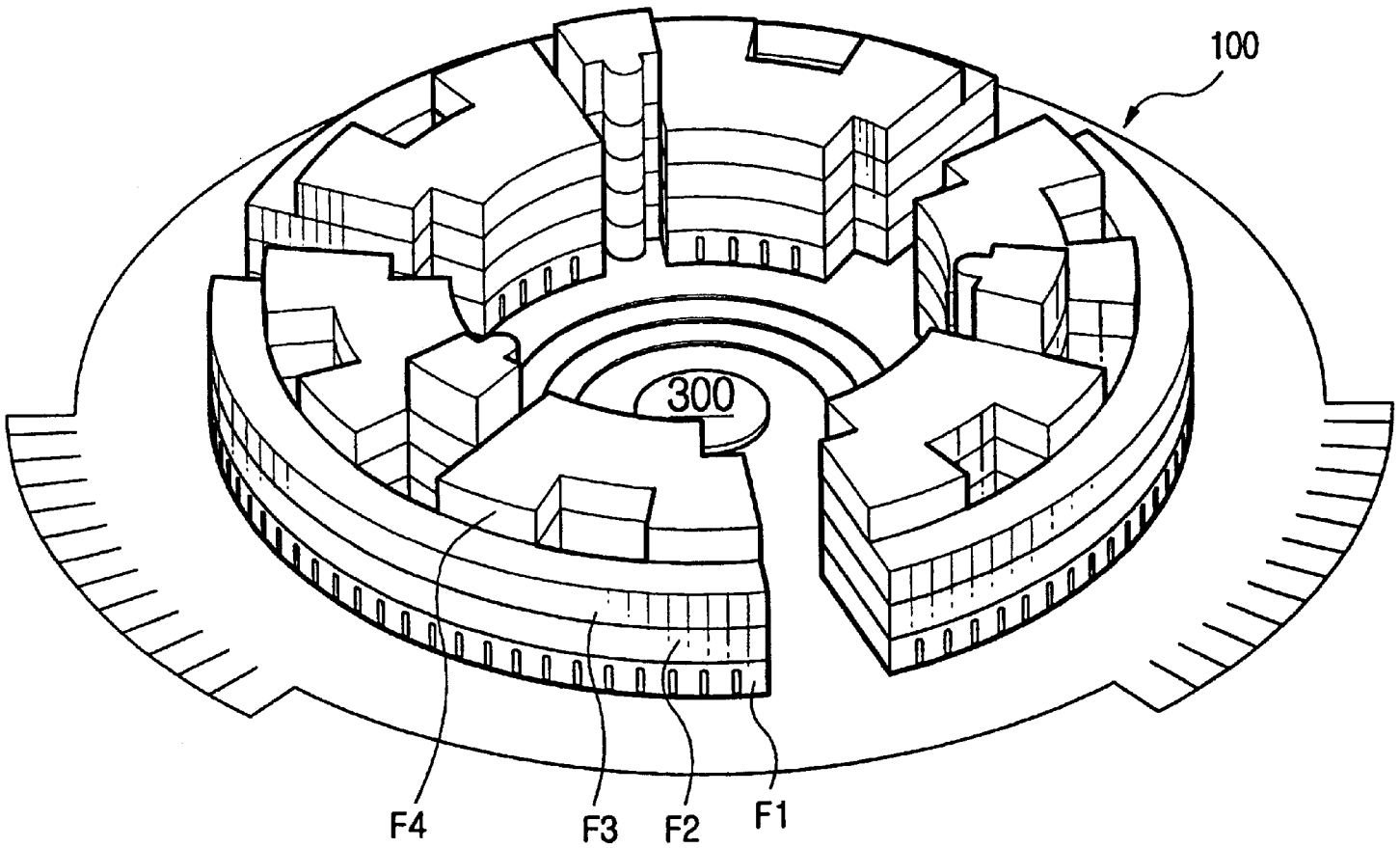
FIG. 2 is an aerial view of an ash laying structure according to the present invention.
Figure 3:
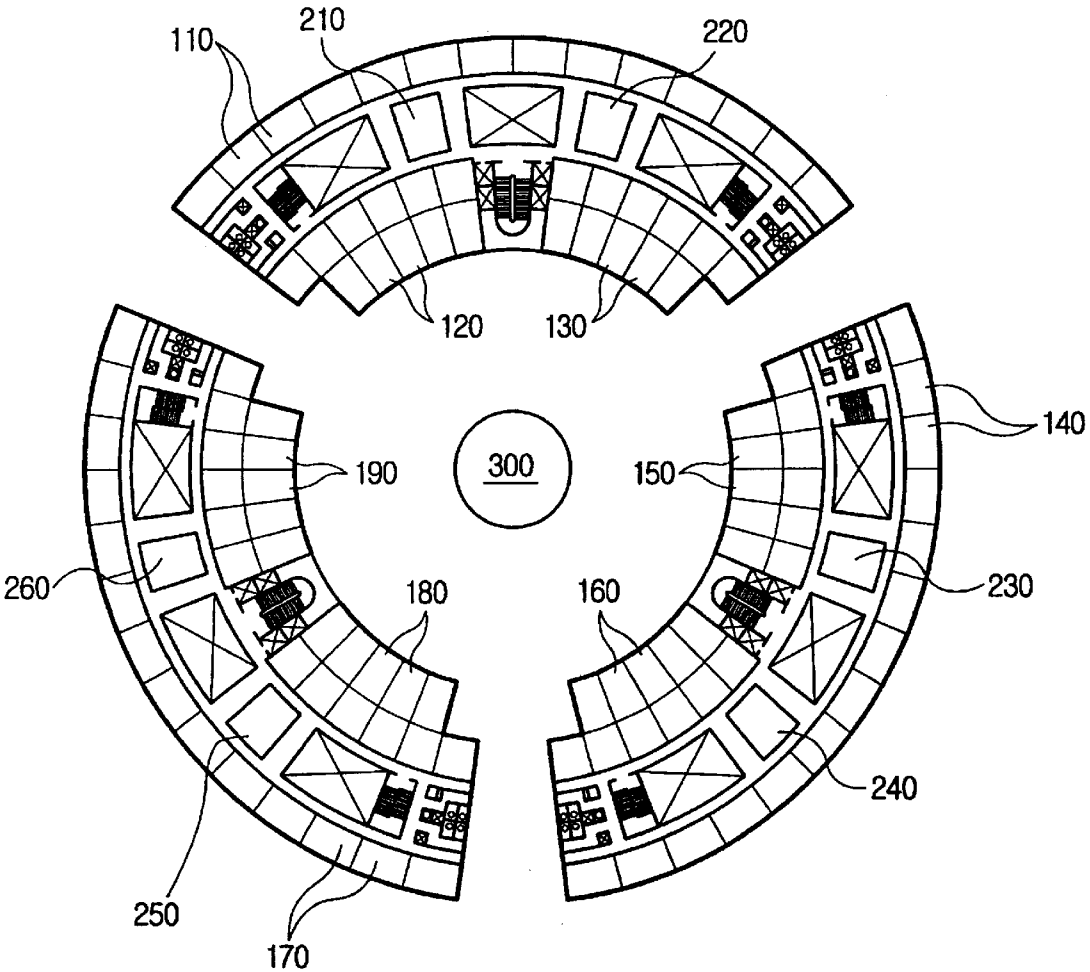
FIG. 3 is a plan view of the ash laying structure according to the present invention.

The ash laying structure is designable to take any shape in consideration of the environments. As shown in FIGS. 2 and 3, the structure is designable in a concentrated circular type or in a general rectangular style. Besides, a mold article, such as a sculpture, a fountain 300, etc., may preferably be installed in the park cemetery for an aesthetic view.

Figure 4:
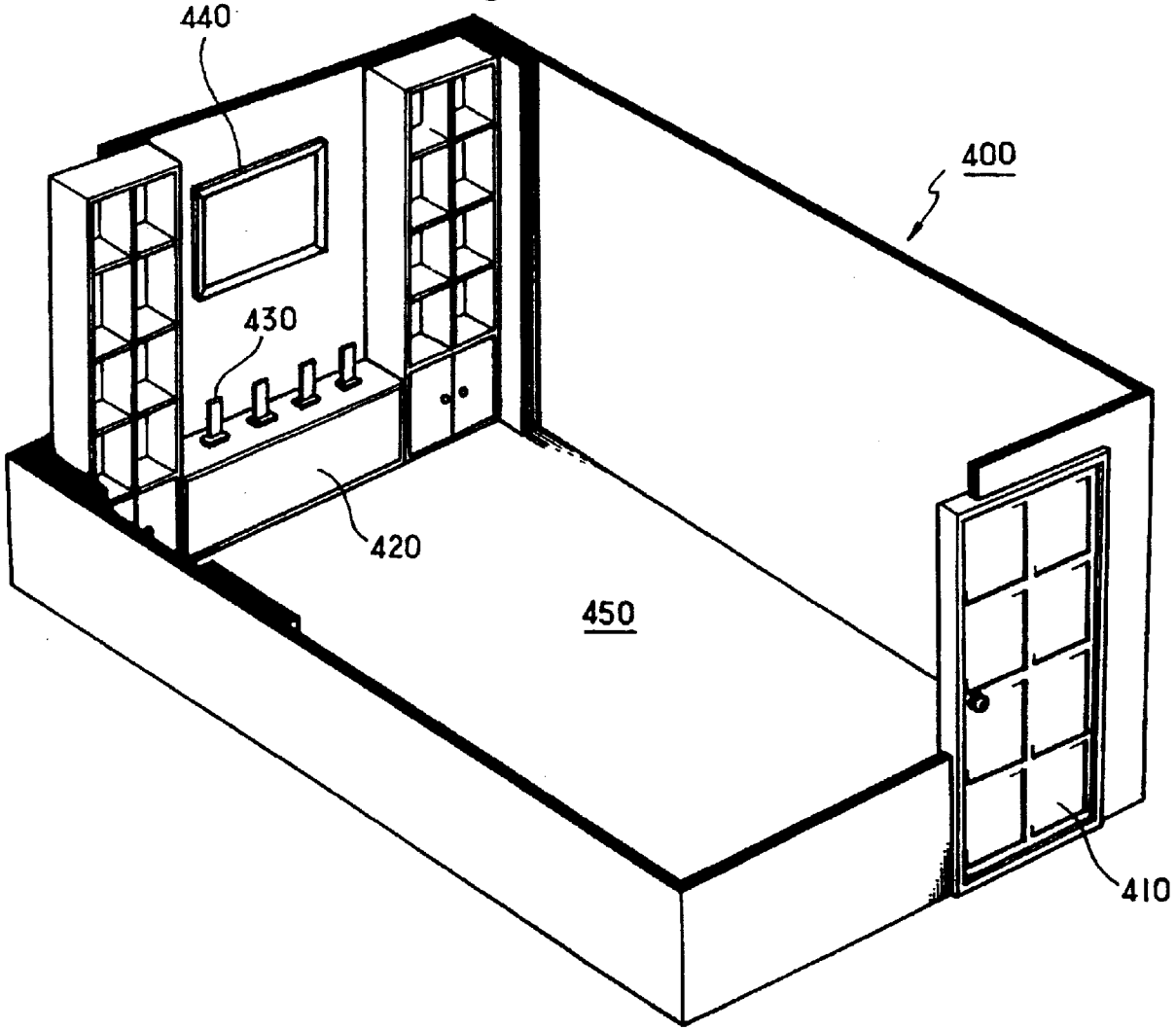
FIG. 4 is a view of an internal constitution of an ash laying room according to the present invention.

Referring to FIG. 4, a main point in installing the ash laying room 400 according to the present invention is to prepare a space where entire ceremonies including a memorial service can be performed according to individuals, families or specific groups, casting off the existing niche-typed ash laying closet.

Each ash laying room 400 may be sold in lots to an individual, a family or a specific group, for example, a head family, a clan, a religious group, a foreigner group, etc.

In case of selling the ash laying room according to the family, the family members can see ashes and articles of the dead at any time in the ash laying room since an ash box within the ash laying room stores the ashes of the dead, and an article box stores the articles left by the dead.

In addition, the space 450 which is needed to perform the ceremony in relation to the memorial service within the ash laying room 400 on an anniversary of the death day or a national holiday, may be used as a space for accommodating the family of the dead participating in the ceremony, and also as a place for chatting or refreshment after the ceremony.

Furthermore, it will be desirable that articles or foods required in the memorial service are usually prepared by a manager to serve a convenience to the family of the dead.

As for the constitution of the ash laying room, a door 410 is installed to perform an open and close operation at one side of the room, and a locker (not shown) is installed to allow only the family or the acquaintances to come in and out. Preferably, the door is provided with a function for setting a secret code and the secret code is endowed to a buyer when purchasing the ash laying room.

The ash/article box 420 is formed in a lateral side facing the door 410, a mortuary tablet 430 is disposed on an upper side of the ash/article box 420, and a portrait 440 of the deceased is attached to a side wall.

The accommodating space 450 formed in front of the ash/article box 420 is utilized as a place for performing the memorial service on the anniversary of the death day or on the national holiday, or as a resting place for the family of the dead after the memorial service.

Since the ash laying structure constructed as above is installed within the park cemetery possessing the variety of cultural centers and facilities, the family using the ash laying structure or neighbors, who do not use directly the ash laying structure but just visit the park cemetery, have an opportunity of intimately getting access to the ash laying structure, serving to give a new impression to the image of burial system based on the ash laying.

That is, if cultural events for the youth or the aged are annually held in the cultural center, the neighbors would look at the ash laying structure not as an unwelcome object but as an intimate object being present along with every day life. The family visiting the sculpture park, the botanical garden, or the likes in order to enjoy themselves on rest days or national holidays may change their preconceived idea about the ash laying structure.

The ash laying room within the ash laying structure according to the present invention has advantages that the family of the dead can visit the ash laying room at a wanted time since each ash laying room has each separated door, and the family who are so busy to make time for preparation can have an agent preparing for the memorial service in place and thus be lent the articles required to the memorial service or supplied with foods at a lower price.

The inside of the ash laying room is designed and constructed based on an appropriate concept according to a nature of the dead, or a tradition and preference of the family by permitting an interior of the ash laying room to be decorated in a new style depending on the demand of the family of the dead. Thus, the ash laying room can also function as a place for education where the family, the acquaintances, and their offspring have chances to become familiar with their family tradition.

Moreover, the individual ash laying room is given a precise management so as not to damage the ashes and the articles left by the dead since a central control system controls inside temperature and humidity of the ash laying room in accordance with environmental variations surrounding the ash laying structure. Since each ash laying structure itself or an entrusted professional management enterprise can monitor trespassers into the ash laying structure and prevent article loss due to a fire, a scientific and systemic management system can be realized, and hence the family of the dead can leave the ashes and articles of the dead with relief.

Figure 5:
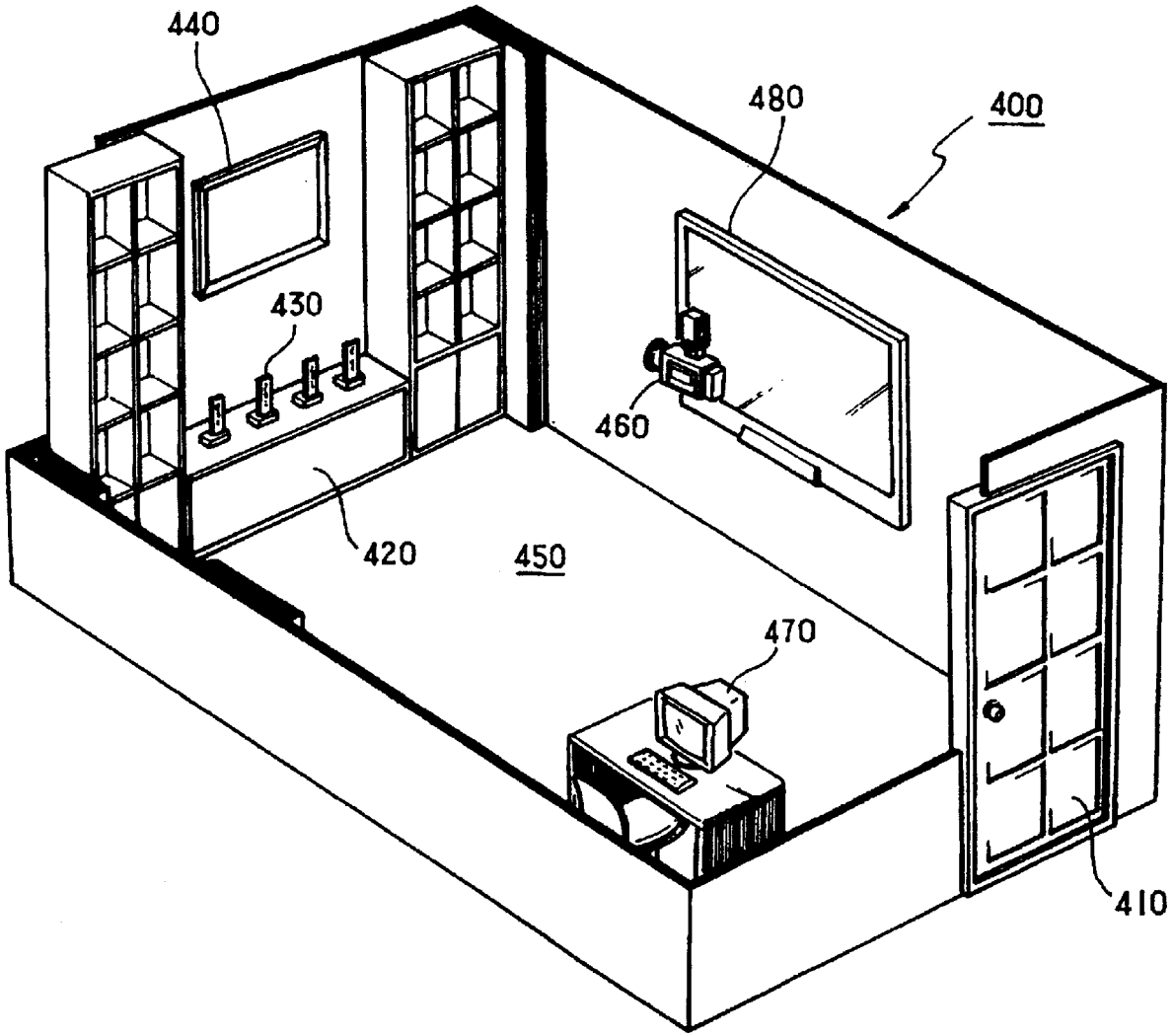
FIG. 5 is a view of an internal constitution of an independently compartmental ash laying room based on a network according to the present invention.
Figure 6:
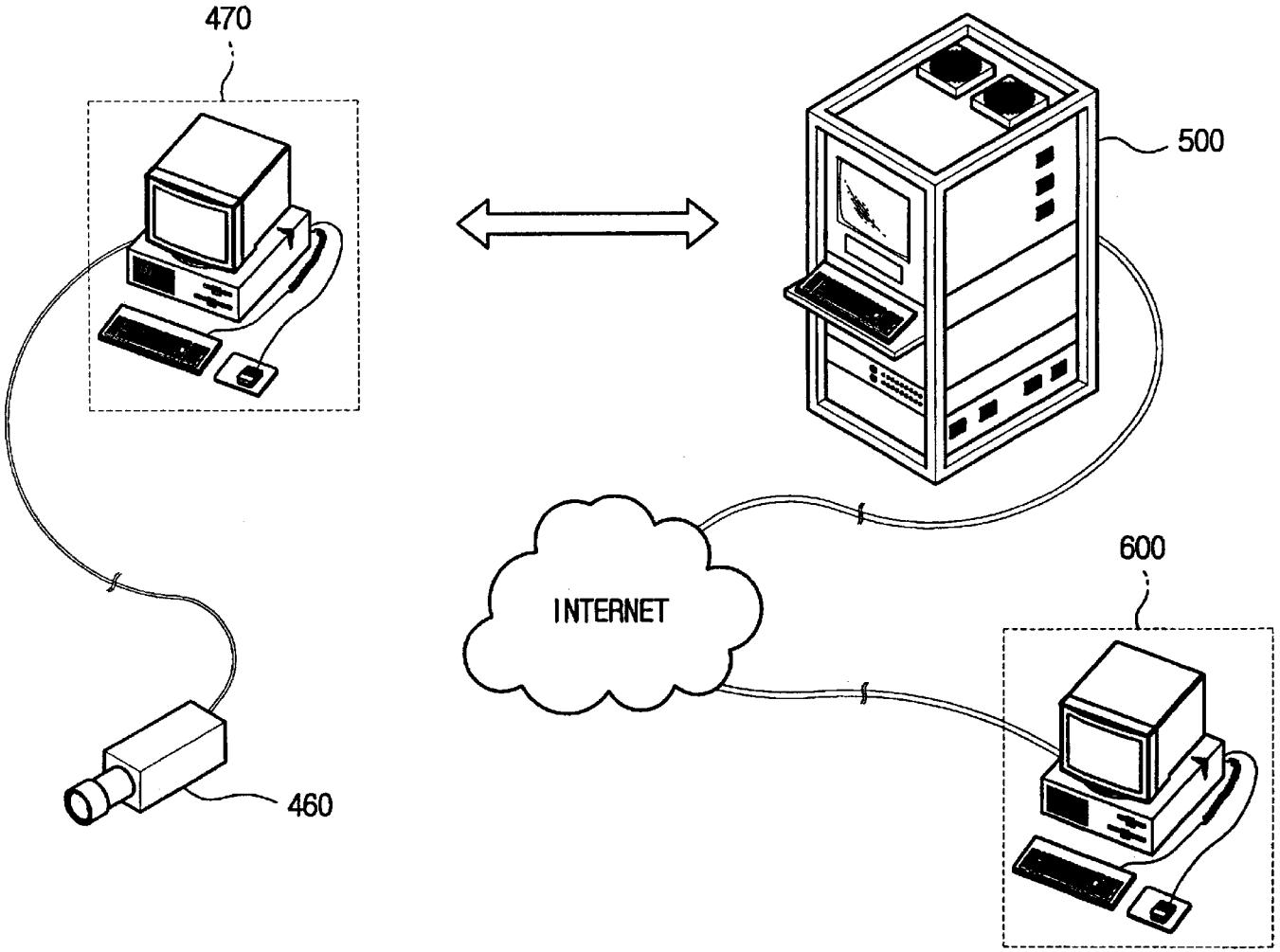
FIG. 6 is a view of a constitution of the network applied to the present invention.

FIG. 5 is a view of an internal constitution of the independently compartmental ash laying room based on a network according to the present invention, whereas FIG. 6 is a view of a constitution of the network applied to the present invention.

Another embodiment of the present invention, as noted below, establishes an intranet having the respective ash laying rooms as clients and transmits various information from the respective ash laying rooms to the outside through Internet.

Referring to FIG. 5, a unmanned camera 460 is installed in the ceiling of the ash laying room at a position appropriate to take a view of the inside of the ash laying room as a whole. A computer 470 is connected to the unmanned camera 460 at one side of the ash laying room to control the unmanned camera 460 and store images transmitted from the unmanned camera 460.

The computer 470 systemically files and stores the variety of materials including the personal information, the death day, the preference, the will, etc., in relation to the dead and further may store voice and pictures of the dead during alive in a real image.

In the meantime, a display panel 480 connected to the computer 470 is attached at a side wall of the ash laying room to display the stored materials about the dead in diverse ways.

Referring to FIG. 6, the computer 470 installed at each ash laying room is connected to an ash laying structure server 500, which is operated by the center, and is also connected to Internet through the ash laying structure server 500. Furthermore, the computer is connected to the family client 600 living in the distance or in foreign countries through Internet. The network described herein above has a well known network constitution but is not limited to the constitution. Other network constitution will be described below in detail.

It will be described herein below a series of processes including a ceremony related to the memorial service, an image transmission, or a material inspection performed by using the ash laying room according to another preferred embodiment of the present invention constructed as above.

Once the unmanned camera 460 takes pictures of the proceeded ceremony related to the memorial service and transmits real images during the process of the memorial service, the computer 470 transmits the real images to the ash laying structure server 500 and further transmits them to the family client 600 living far away or in foreign countries through Internet. Conversely, on the side of the family client 600 of the dead, once they connects to Internet through their own computer, and connects to the ash laying structure server 500, they can receive the real images transmitted from the pertinent ash laying room in real time. Technology with respect to this transmission will be omitted since it is generally known.

Hence, the family who can not participate in the memorial service because of their residence in the distance or in foreign countries can indirectly participate in the ceremony through the real images transmitted thereto, thereby increasing psychological satisfaction of the family of the dead.

Besides, after finishing the memorial service, the acquaintances can ask each other how they are doing and notify a schedule related to the memorial service through the image communication, resulting in a solidification of their ties.

Moreover, the unmanned camera 460 performs a security function of monitoring the trespasser invading into the inside of the ash laying room 400 at ordinary times.

In the meanwhile, the computer 470 systemically files and stores the materials in relation to the dead in various types, and ensures the reading of the materials at any time, if necessary. Further, the display panel 480 displays the materials in case that the ceremony for the memorial service is hold or the family or the acquaintances visit the ash laying room. For instance, the display panel 480 provides the pictures of the dead taken while being alive together with the voice of the dead in the real image, or shows a pre-produced material about family history, thereby functioning as an educational medium of making the offspring familiar with the family tradition.

The present invention constructed as above has an advantage of allowing maximal interments per area and maximal utilization of the land by integrating the ash laying rooms in a large scale within a predetermined space The present invention has another advantage that the ash laying room can be used almost eternally over many generations in a state that the ashes are preserved therein by employing a modern style structure.

The present invention has further another advantage of easily isolating and protecting the ash laying rooms from the outside by individually dividing the ash laying rooms in the form of cells within the ash laying structure.

Besides, the independently compartmental ash laying structure according to the present invention has still another advantage of serving to improve the burial system by being constructed in modem style, whether in a downtown or suburbs, and thus acting as a structure well matched with surrounding scenic beauty, thereby inducing the neighbors to take a liking to the hitherto unwelcome ash laying structure. Preferably, it may advance stability against often generated earthquakes by designing the structure to have a great resistance against the earthquakes.

The independently compartmental structure according to the present invention has yet another advantage of strengthening the ties between the family members and reinforcing the security of the ash laying room at ordinary times by transmitting the image of the memorial service received from the installed unmanned camera to the outside and finally giving the opportunity to the family including those living abroad, who can not participate in the memorial service, to indirectly participate in the ceremony.

The independently compartmental structure according to the present invention has yet another advantage of producing the educational effect by storing and managing the various materials regarding the dead during pre or post-death in writing or image, and ensuring the display of the stored materials on receipt of demands, thereby allowing the clear audio-video education about the family history to the offspring.

While the invention has been shown and described with reference to certain preferred embodiments thereof, it will be understood by those skilled in the art that various changes in form and details may be made therein without departing from the spirit scope of the invention as defined by the appended claims.

What is claimed is:

1. A charnel system having independently divided cells, comprising:

a plurality of ash laying rooms, which are individually divided and arranged in a cell form, rest areas and facilities functioning as a resting place, a central control space for controlling the plurality of ash laying rooms and the rest areas and facilities in a centralized manner;

the plurality of ash laying rooms are connected to a central control server connected to the Internet through communication networks, each of the ash laying rooms further including:

a unmanned camera for monitoring the memorial service and enabling a picture communication with the family of the deceased who live far away or overseas and cannot participated in the memorial service;

a computer connected to the Internet for receiving images data from the unmanned camera, transferring the image data to the central control server, receiving image information of the family of the deceased living far away from the central control server and storing and managing information materials related to the deceased; and a displaying unit connected to the computer for displaying the image information of the family living far away and the information materials related to the deceased.

2. The charnel system having independently divided cells of claim 1, wherein the ash laying room has a door for controlling entrance and exit, a space for performing a ceremony in relation to a memorial service, an ash box for storing ashes or articles according to individuals, families, or specific groups.

3. The charnel system having independently divided cells of claim 2, wherein the memorial service performing space further includes an altar being disposed at a proper position adjacent to the ash box for arranging a mortuary tablet, a portrait and memorial service articles thereon and a receiving space for string the memorial service articles.

* * * * *

UNITED STATES PATENT AND TRADEMARK OFFICE

CERTIFICATE OF CORRECTION

PATENT NO. : 6,634,143 B2
DATED : October 21, 2003
INVENTOR(S) : Yoo

It is certified that error appears in the above-identified patent and that said Letters Patent is hereby corrected as shown below:

Column 7,
Line 9, change “are” to -- being --;
Between lines 12 and 13, insert the following paragraph:
-- an ash box for storing ashes or articles according to individuals, families, or specific groups, --;
Line 13, change “a” to -- an --;
Line 16, change “participated” to -- participate --;

Column 8,
Line 9, after “exit,” insert -- and --;
Line 10, after “service” delete “, an ash box for”;
Line 11, delete in its entirety;
Line 12, delete “specific groups”;
Line 14, change “claim 2” to -- claim 1 --;
Line 15, delete “being”;
Line 18, change “string” to -- storing --.

Signed and Sealed this

Tenth Day of February, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,634,143 B1
DATED : October 21, 2003
INVENTOR(S) : Yoo

It is certified that error appears in the above-identified patent and that said Letters Patent is hereby corrected as shown below:

Title page,
Item [76], Inventors, should read -- Gwang-Jin Yo, Saetbyeol-Maeul, 34 Bundang-gu Seongnam, Gyeonggi-do, 463-030 (KR) --

Signed and Sealed this

Eighteenth Day of May, 2004

JON W. DUDAS
*Acting Director of the United States Patent and Trademark Office*